United States Patent [19]

Kacmarcik

[11] 4,329,072

[45] May 11, 1982

[54] RIBBON FEED AND LIFT MECHANISM FOR A TYPEWRITER

[75] Inventor: Donald J. Kacmarcik, Lexington, Ky.

[73] Assignee: International Business Machines Corporation, Armonk, N.Y.

[21] Appl. No.: 89,662

[22] Filed: Oct. 30, 1979

[51] Int. Cl.[3] ..... B41J 33/14

[52] U.S. Cl. ..... 400/208; 400/212; 400/214; 400/225; 400/227; 400/236.1; 400/696; 400/697.1

[58] Field of Search ..... 400/144.2, 145, 208, 400/212, 214, 216.1, 225, 227, 229, 236.1, 335, 696, 697, 697.1

[56] References Cited

U.S. PATENT DOCUMENTS

| | | | |
|---|---|---|---|
| 679,686 | 7/1901 | Shirk | 400/208 |
| 710,144 | 9/1902 | De Wallace | 400/236.1 X |
| 3,859,712 | 1/1975 | Tramposch | 400/145 X |
| 3,871,507 | 3/1975 | Perry et al. | 400/208 |
| 3,904,017 | 9/1975 | Frechette | 400/697.1 X |
| 3,905,465 | 9/1975 | Frechette et al. | 400/697.1 X |
| 3,927,746 | 12/1975 | Wolowitz | 400/697.1 X |
| 4,010,839 | 3/1977 | Guerrim et al. | 400/227 X |
| 4,030,591 | 6/1977 | Martin et al. | 400/144.2 X |
| 4,111,293 | 9/1978 | Kockler et al. | 400/335 X |
| 4,203,677 | 5/1980 | Hatsell | 400/697.1 X |

FOREIGN PATENT DOCUMENTS

| | | | |
|---|---|---|---|
| 2337626 | 4/1974 | Fed. Rep. of Germany | 400/212 |
| 2515899 | 10/1976 | Fed. Rep. of Germany | 400/208 |

OTHER PUBLICATIONS

IBM Technical Disclosure Bulletin, "Erase Ribbon Lift and Advancing Mechanism", Mathews, vol. 19, No. 7, Dec. 1976, pp. 2393–2394.

IBM Technical Disclosure Bulletin, "Two-Color Cartridge Ribbon System with Correction", Schaefer, vol. 22, No. 6, Nov. 1979, pp. 2327–2329.

IBM Technical Disclosure Bulletin, "Ribbon Cartridge", Okcuoglu, vol. 22, No. 9, Feb. 1980, p. 4120.

IBM Technical Disclosure Bulletin, "Multiple Ribbon Cartridge Color Printer", Meier et al., vol. 22, No. 10, Mar. 1980, pp. 4481–4482.

*Primary Examiner*—Ernest T. Wright, Jr.

*Attorney, Agent, or Firm*—William J. Dick

[57] ABSTRACT

In a daisy wheel or rotary print wheel typewriter, a single motor (stepper motor) is employed to accomplish both ribbon lift and feed for typewriter ribbon and correction ribbon loaded in a cartridge assembly. A single motor drive moves a cartridge assembly support about an axis to present either the typewriter ribbon or the correction ribbon to the print point at the print line. In the first portion of the arc that the cartridge assembly moves, normal typing on the typewriter ribbon occurs, only the feed ratchet for the typewriter ribbon being engaged. Alternately, when the rotation is greater, to present a correction ribbon at the print line, the added elevation of the cartridge assembly causes disengagement of the normal ratchet feed for the typewriter ribbon but allows advancement of the correction ribbon.

21 Claims, 5 Drawing Figures

RIBBON FEED AND LIFT MECHANISM FOR A TYPEWRITER

RELATED APPLICATIONS

See U.S. patent application Ser. No. 89,661 filed concurrently herewith by Donald J. Kacmarcik et al and entitled "Ribbon Feed and Lift Mechanism for A Typewriter".

SUMMARY OF THE INVENTION AND STATE OF THE PRIOR ART

The present invention relates to typewriters and more specifically relates to improved ribbon feed and cartridge lift mechanism for presenting different portions of a typewriter ribbon or a correction ribbon to a print point along a print line of a typewriter and automatic feeding of the ribbon dependent upon the cartridge elevation.

There are numerous instances in the prior art of typewriter ribbon as well as correction ribbon feed which are coupled to mechanism for elevating or presenting different portions of typewriter ribbons as well as correction ribbons to a print line. For example, see patent application Ser. No. 801,286, filed May 27, 1977, inventor—J. O. Schaefer and entitled "Typewriter Cartridge and Feed Mechanism Therefor" which discloses a typewriter ribbon cartridge assembly including typewriter ribbon and correction ribbon in which separate drives are employed for elevating and depressing the cartridge assembly to present ribbon at the print point, and for feeding the ribbon, depending upon whether it is a print ribbon or correction ribbon, the dependence being upon the elevation of the cartridge about its supporting platform.

As presently advised, the most pertinent prior art is a portion of applicant's and his co-inventors work set out in the co-pending patent application, Ser. No. 89,661 filed concurrently herewith by Donald J. Kacmarcik et al and entitled "Ribbon Feed and Lift Mechanism for A Typewriter". More specifically, the embodiment illustrated in FIGS. 3–7 therein was reduced to practice before applicant's invention as disclosed herein. Other pertinent art is U.S. Pat. No. 4,111,293, issued on Sept. 5, 1978 and U.S. Pat. No. 710,144, issued on Sept. 30, 1902. The '293 patent does illustrate a single cartridge and reciprocation of the cartridge to present ribbon at the print point but utilizes a double motor drive, that is one motor for advancing the ribbon and a second solenoid motor for actuating and effecting the ribbon lift. In the present instance, as will be more completely explained hereinafter, both ribbon lift and drive are accomplished by a single drive motor. The '144 patent, alternatively, discloses a date stamp operation mechanism in which a hand lever having a pair of pawls may be put into one of two positions, first to actuate one ratchet and then a second ratchet.

In view of the above, it is the principle object of the present invention to provide an improved simplified and economical ribbon lift and feed mechanism for a typewriter, specifically a typewriter of the single element type.

Another object of the present invention is to provide a single stepping motor control for both ribbon lift and feed for multiple ribbon cartridges carrying both typing ribbon and a correction ribbon.

Other objects and a more complete understanding of the invention may be had by referring to the following specification and claims taken in conjunction with the accompanying drawing.

DRAWING DESCRIPTION

Figure 2:
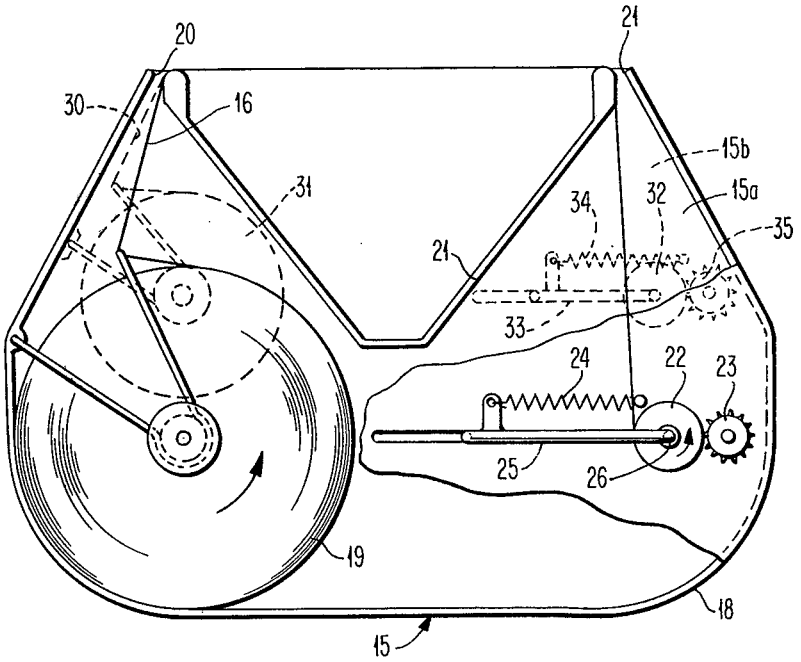
FIG. 2 is an enlarged fragmentary plan view of a typical cartridge assembly which may be employed with the apparatus of the present invention.
Figure 3:
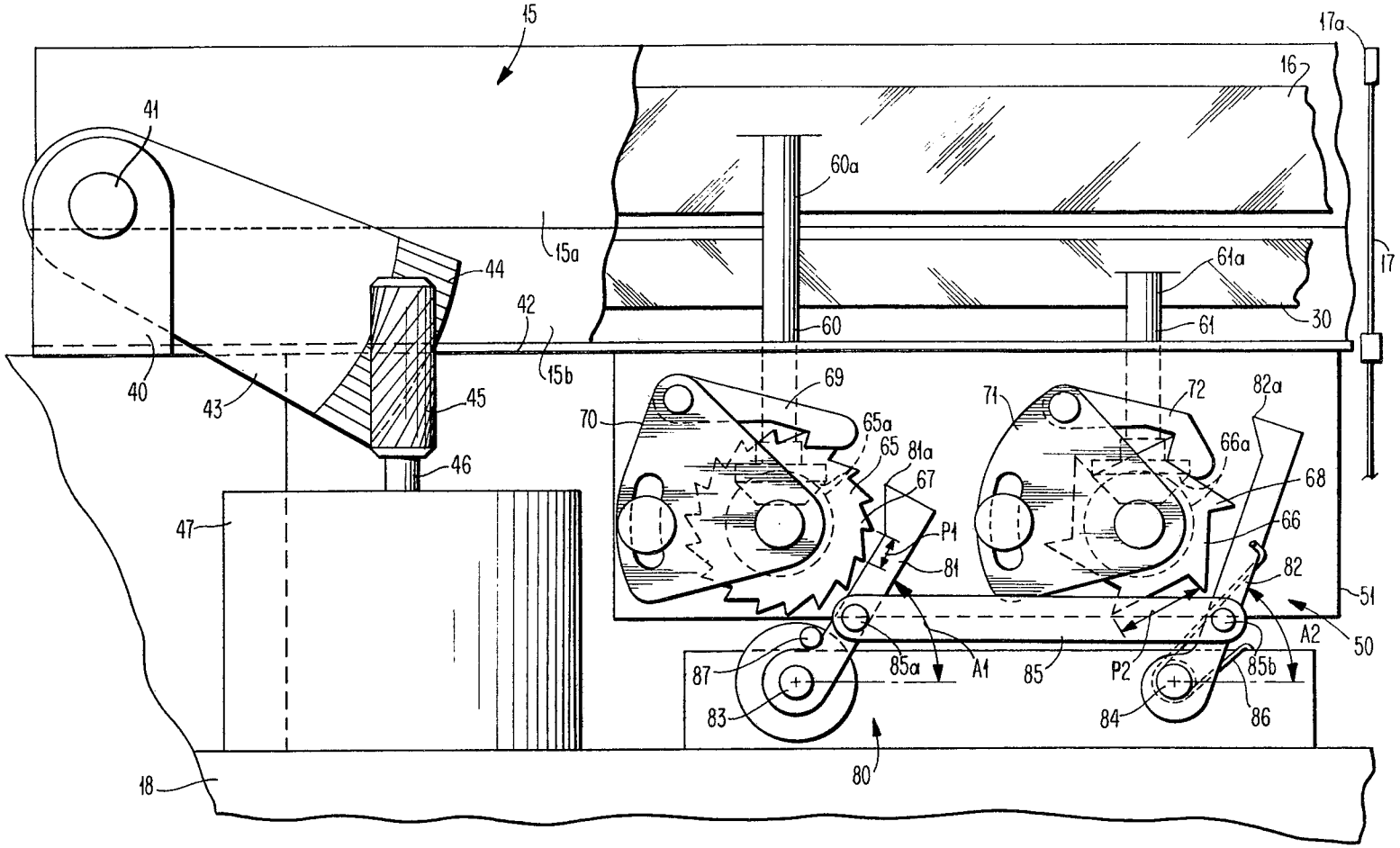
Figure 4:
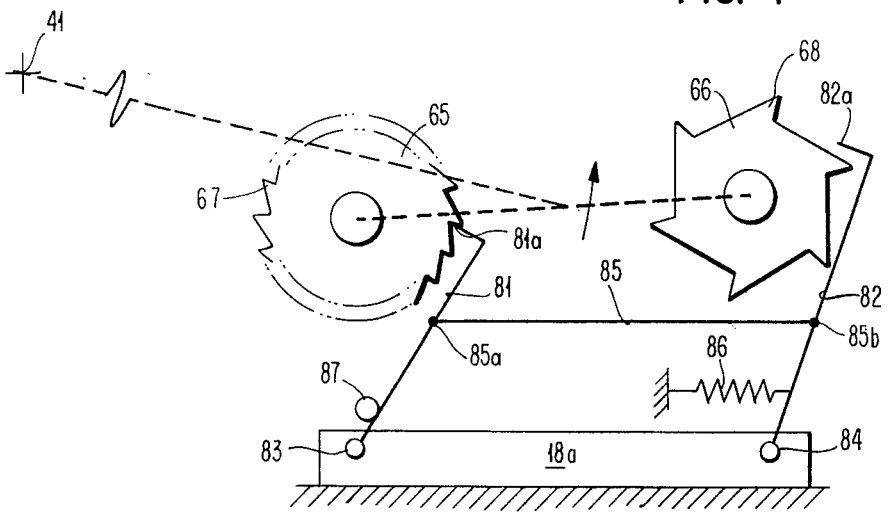
Figure 5:
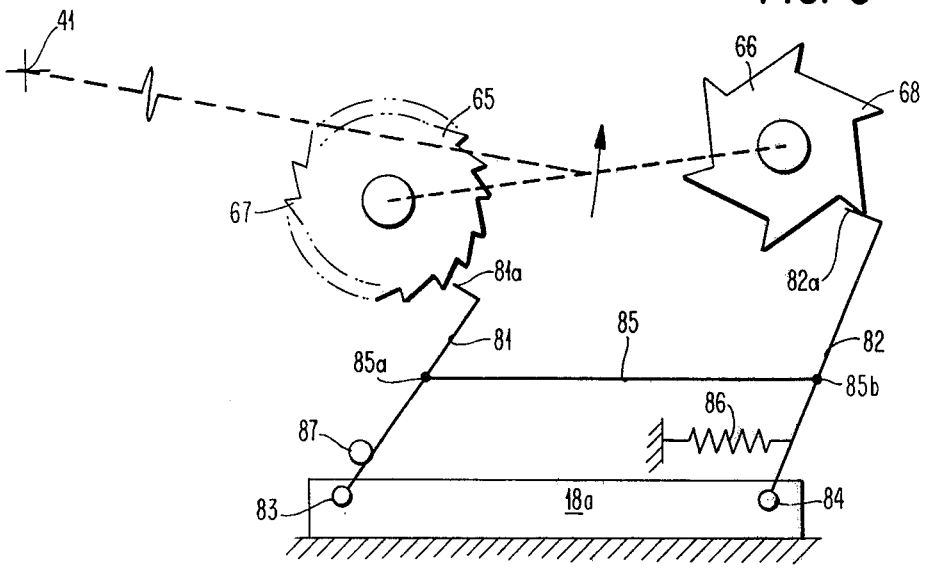

FIG. 3 is a fragmentary sectional side elevational view of the apparatus of the present invention and illustrating both the ribbon lift and ribbon advance features of the present invention as with a cartridge of the type illustrated in FIG. 2; and FIGS. 4 and 5 are schematic representations of a portion of the apparatus illustrated in FIG. 3 and showing how the typing ribbon and the correction ribbon may be driven.

Figure 1:
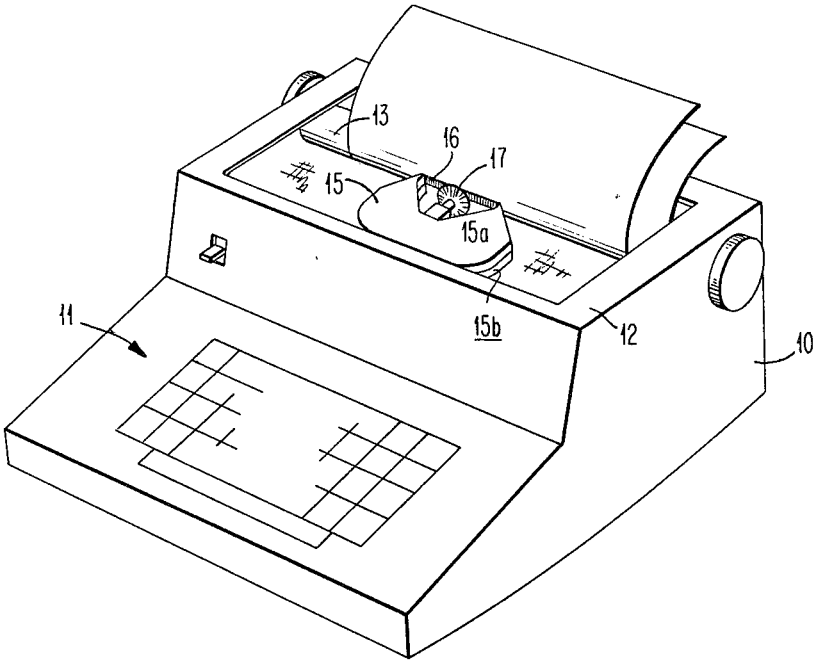
FIG. 1 is a perspective view of a typical typewriter of the single element type, specifically a rotary print wheel typewriting apparatus which is constructed in accordance with the present invention.

Turning now to the drawing, and especially FIG. 1 thereof, a typical typewriter 10 including a keyboard 11, frame 12 and paper receiving platen 13 are illustrated therein. Nested within the portion adjacent to platen 13 is a cartridge assembly 15 which includes at least a typewriter ribbon or the like 16 which passes exteriorally of the cartridge 15 intermediate the platen 13 and, in the illustrated instance, a print wheel or the like 17. The print wheel construction is similar to that found in many state of the art typewriters, and may typically be of the construction illustrated in U.S. Pat. No. 3,859,712. Typewriters of this type (single element type) typically mount the ribbon feed and lift on a carrier which translates between left and right margins associated with the platen along a print line.

A typical ribbon cartridge assembly 15 is illustrated in FIG. 2, and includes a casing 18 of a ribbon cartridge **15*a* having a print ribbon supply spool 19 for providing print ribbon 16 through an opening 20 externally of the casing 18. As illustrated, the print ribbon 16 traverses a recessed portion 21 in the casing 18 which provides an opening for the print wheel 17, the ribbon 16 entering a second aperture or opening 21*a* and being supplied to a take up spool 22. The take up spool 22 is biased against an internally and rotatably mounted spiked wheel driver 23 as by a biasing spring 24 which serves to bias a rod 25 which is captured at one end 26 by the take up spool 22 effectively pressing the take up spool 22 against the spiked wheel driver 23. In this manner, as the spiked wheel driver 23 rotates, the take up spool 22 becomes larger biasing the spring 24 but allowing for uniform increments of ribbon feed. Moreover, the diameter of the spiked wheel driver 23 may be changed depending upon the type of ribbon 16 being employed with the particular cartridge 15*a*. For example, with a standard carbon type ribbon, no overlap between adjacent characters being printed is permissible and the feed rate of the ribbon as typing or printing progresses must be, in effect, greater than if the cartridge houses a multistrike ribbon. Immediately below the casing 18 is a second cartridge 15*b* which may snap together to form the cartridge assembly 15 or, in the alternative may be incorporated as part of the casing 18 to make the cartridge assembly 15. In either instance, (and for purposes of this application it is immaterial which form is desired), the second cartridge 15*b* of the cartridge assembly 15 includes a second ribbon, in the preferred embodiment a correction ribbon 30 which may include lift off or cover-up type material. The correction ribbon 30 is wound upon a supply spool 31, and extends through the opening 20 (or alike in putting on a separate cartridge) and then proceeds through the opening 21***a* to a correction ribbon 30 take-up spool 32. The correction ribbon 30 take-up spool 32 is biased in a similar manner to the print ribbon 16 take-up spool 22 as by a rod 33, which is biased by a spring 34 which in turn biases the take-up spool 32 against a second spiked wheel driver 35, rotatably mounted within the cartridge assembly 15. A typical way in which the cartridges may be snapped together, if separate cartridges are desired to make up the cartridge assembly 15, is illustrated in application Ser. No. 008,461, filed on Feb. 1, 1979 in an application of Boyatt, et al. and entitled "Cartridge Assembly Apparatus for A Typewriter", (now U.S. Pat. No. 4,239,107, issued on Dec. 16, 1980) herein incorporated by reference, or in the Schaefer application, Ser. No. 801,286, filed on May 27, 1977, heretofore mentioned.

In accordance with the invention, novel means are provided for supporting the cartridge assembly 15 and reciprocating or oscillating the assembly between a home position to permit typist visibility of the print line, and an elevated position to present a portion of the print ribbon 16 intermediate the wheel 17 and the platen 13 of the typewriter, and for selectively feeding or incrementing either one of ribbon 16 or 30 depending upon the elevation of the cartridge assembly 15, without effecting feeding of the other of the ribbons 16, 30. To this end, and referring first to FIG. 3, the carrier 18*a* mounts thereon the implements of printing including the print wheel 17 and its associated drive (not shown) as well as the cartridge assembly 15 and its drive. As illustrated, the carrier 18*a* includes upstanding posts or brackets 40 through which is journaled an axle 41 and a depending cartridge support means or platform 42. Connected to the axle 41 is an extending gear segment 43 which includes teeth 44 on the extended terminal end thereof. The teeth 44 mesh with a pinion gear 45 which is connected to the shaft 46 of drive means, in the illustrated instance and preferred embodiment, a stepping motor 47. Inasmuch as the gear segment 43 is connected to the axle 41 which is connected in turn to the support platform 42, it is easy to see the rotation of the stepping motor 47 will effect elevation or rotation of the cartridge support platform 42 about the brackets 40 presenting one or the other of the ribbon 16 and 30 to and in front of the printing portion (print petal 17*a*) of the print wheel 17, depending upon the steps of the motor 47, and the gear ratio between the gear segment 43, and the pinion gear 45, as well as the number of steps per revolution of the stepping motor 47.

In order to position the new or fresh ribbon portion (print ribbon 16 or correction ribbon 30) intermediate the petal 17*a* on the print wheel 17 and the platen 13, ribbon drive means 50, dependent upon the distance of the reciprocation of the cartridge assembly 15 about the axle 41, effect independent driving of the print ribbon 16 and correction ribbon 30. To this end, the ribbon drive means 50 includes a bracket means or housing 51 which is connected to and depends from the cartridge assembly support means or platform 42 so as to effect reciprocation or oscillation of the housing 51 as the platform 42 reciprocates. Interiorally of the housing 51 are first and second ratchet members 65 and 66 respectively, the ratchet member 65 being, as through beveled gears 65*a*, connected to an upstanding shaft 60 which projects through the cartridge assembly support means 42 and terminates in a spline like end 60*a* for coupling to the spiked wheel driver 23. In a like manner, the ratchet member 66 is connected through bevel gears 66*a* to a second upstanding pin 61 which also terminates in a spline like end 61*a* for coupling to the spiked wheel driver 35. As shown, the ratchet members 65 and 66 include radially projecting and circumferentially extending teeth 67 and 68 respectively, the pitch P1 of the teeth 67 being less than the pitch P2 of the teeth 68. Moreover, mounted interiorally of the housing 51 for engagement respectively with the ratchet member 65 and 66 are back-check pawl means 69 and 72, the back-check pawl means 69 being mounted on an adjustable bracket 70, while the back-check pawl means 72 being mounted on an adjustable bracket 71. The back-check pawl means 69 and 72 operate in a conventional manner to inhibit, in the illustrated instance, clockwise rotation of the ratchet members 65 and 66.

In order to drive the ratchet members 65 and 66 during oscillation or reciprocation of the platform 42 about the axle 41, (which forms an axis for the cartridge assembly 15), and more specifically to drive the ratchet members 65, 66 only upon a predetemined throw of the platform 42 about the axis of the axle 41, drive pawl means 80, in the illustrated instance two such pawls 81 and 82 having ratchet teeth engaging means 81*a* and 82*a* respectively thereon, are each pivotally connected to the carrier 18*a* as by pivot pins 83 and 84. As illustrated, the drive pawls 81 and 82 are interconnected as by a link 85 with pivot pins 85*a* and 85*b* connecting respectively the drive pawls 81 and 82. In this manner, as one of the pawls 82, 82 engages the respective ratchet member 65, 66, motion of that pawl 81, 82 about its associated pivot 83 or 84 will be transmitted by way of the link 85 to the other of the drive pawls 81, 82. Moreover, a bias spring 86 tends to bias the drive pawls 81 and 82 towards their respective ratchet members 65 and 66.

In order to inhibit rubbing of the drive pawls 81 and 82 against the ratchet members 65 and 66 respectively, due to the pressure of spring 86 effecting such rotation of the drive pawls 81, 82 about their pivot pins 83 and 84, an adjustable pawl stop member 87 limits the rotation of the drive pawl 81, and because of the coupling between the drive pawls 81 and 82 as by the link 85, drive pawl 82 is stopped in a like manner from excessive rotation.

In operation, as the cartridge assembly support means or platform 42 is rotated about the axle 41 to present the typing ribbon 16 opposite the print petal 17*a* of the print wheel 17, the housing 51 moves upwardly with the platform 42 until the ratchet teeth engaging means 81*a* comes into engagement with the teeth 67 of the ratchet member 65. As the platform 42 descends due to the reversal of rotation of the stepping motor 47, the engagement of the ratchet teeth engaging means 81*a* or projection 81*a* of the drive pawl 81 effects counterclockwise rotation of the ratchet member 65 allowing the spiked wheel driver 23 associated with the typing ribbon 16 to be advanced. The pitch of the teeth 67 on ratchet member 65 is such that a full segment of the arc of travel of the platform 42 is essential in order to allow the ratchet teeth 67 of the ratchet member 65 to be engaged by the ratchet teeth engaging means or projection 81*a* of the pawl 81. In this manner, the typing ribbon 16 may be for example, correctable film ribbon or may be the well known multistrike ribbon so that numerous characters or indicia may be printed before the ribbon spiked wheel driver 23 effects feeding of the ribbon 16. Thus the pitch of the teeth 67 must be sufficient to permit typing to occur on any part of the ribbon 16 until the lowermost point of the ribbon 16 is opposite the print petal 17*a* (or any other desired portion) in order to effect feeding of the typewriter ribbon 16. Thus it is preferable that a full segment of arc equivalent to the width of the ribbon 16 (or at least the distance from the highest to the lowest typing track) be achieved before the drive pawl 81 engages the ratchet member 65 and rotation of the ratchet member 65 occurs. Another way of looking at the relationship between the drive pawl 81 and the teeth 67 of ratchet member 65 is that upon reciprocation of the support means 42 a distance equal to or greater than the pitch P1 but less than the pitch P2, the drive pawl 81 will engage a tooth 67 of the typewriter ribbon ratchet member 65 causing ribbon 16 to advance.

Drive pawl 82 is longer or extends further into the housing 51 than drive pawl 81, the reason for which will become more clear hereinafter. During the normal printing cycle wherein the typing ribbon 16 is presented opposite the type petal 17*a* for normal printing, the ratchet teeth engaging means or projection 82*a* of pawl 82 does not engage the teeth 68 of ratchet member 66 inasmuch as the throw of the housing 51 is insufficient to cause such engagement. However, when it is desired to place the correction ribbon 30 opposite the print petal 17*a*, the platform 42 of necessity must be raised higher about pivot axis 41, the length of the movement being such that the projection 82*a* of the drive pawl 82 engages, upon depression of the platform 42 with a tooth 68 of the ratchet member 66, further depression causing counterclockwise rotation of the ratchet member 66. Due to the mechanical advantage of pawl 82 being at a steeper vertical angle than pawl 81 (i.e., $A1<A2$), the pawl 82 will be cammed to the right or clockwise about its pivot pin 84 by engagement of a tooth 68 of the ratchet member 66, and because of the link 85 interconnecting the drive pawls 81 and 82, drive pawl 81 will also be rotated clockwise inhibiting engagement of its ratchet teeth engaging projection 81*a* with the teeth 67 of the ratchet member 65. In this manner, during a correction cycle, drive pawl 81 is pulled away from the ratchet member 65 and no typing ribbon 16 is fed. It should be noted that the support means 42 movement is such that at the pawl 82, displacement is greater than the pitch P2 of the teeth 68 of the ratchet member 66. Additionally, the result is enhanced by the outside diameter (tooth-tip to tooth-tip) of ratchet member 66 exceeding the outside diameter of the ratchet member 65. Moreover geometrical analysis indicates that an arc drawn from the axis of rotation of the platform 42 (i.e., axle 41) should theoretically pass through the pitch lines of contact of the drive pawls 81 and 82 and their respective ratchet members 65, 66 and the axis of rotation of the drive pawls 81, 82 (i.e., pivot pins 83, 84).

Because both lift and ribbon feed are accomplished by a single stepping motor 47, virtually any ribbon may be employed merely by substituting a cartridge assembly having differing diameter spiked wheels (23, 35, FIG. 2). For example with a multi-strike ribbon such as the IBM Tech III print ribbon which may be packaged with a cover up tape as the correction ribbon, or correctable film ribbon with a so called lift-off tape as the correction ribbon may be packaged together to form the cartridge assembly 15. By way of example, in the multi strike ribbon there may be a 5 track lift pattern which then can be followed by 1 mm feed increment, while in a correctable film ribbon a 2 track lift pattern may be employed which is followed by a 3 mm feed increment. This is accomplished merely by setting the pitch of the ratchet member for the print ribbon such that a full segment of arc of travel of the catridge assembly is necessary before the drive pawl engages the associated ratchet member to effect such rotation.

Moreover, the increments of lift may be set simply by the ratio of the gearing between the pinion 45 and the gear segment 43 depending upon the ribbon width, the position of the ratchet members 65, 66 within the housing 51 and the pitch of the teeth of the ratchet members 65, 66. For example, assume that the gear ratio between the pinion 45 and the gear segment 43 is such that two steps of the stepping motor 47 yields one increment of lift. From the home position, 12 steps of the motor 47 will lift the cartridge assembly 15 and thus the print ribbon 16 to, for example, its first typing track. From there and the instance of a multi strike ribbon, 2 steps are required for each increment of lift until the fifth track, then down to track 1 level (or below to the home position) and so forth. With a correctable film ribbon as an example, wherein there are two tracks, 8 lift increments (16 motor steps) are required to lift it sufficiently to place the lift off tape or correction ribbon 30 opposite the type or petal 17*a* on the print wheel 17 for a lift off correction.

It should be recognized that the circuitry which operates the stepping motor may be of any convenient type, one such example being illustrated in U.S. Pat. No. 4,030,591, issued on June 21, 1977 to Morton et al. Moreover, a sample of the circuitry, which may be of any convenient type, is illustrated in co-pending patent application Ser. No. 89,661 filed concurrently herewith by Donald J. Kacmarcik et al which is herein incorporated by reference U.S. Pat. No. 4,247,210, issued on Jan. 27, 1981).

Thus the apparatus of the present invention permits an elegantly simple way of combining, with a single motor drive, both ribbon lift and feed so as to present one of a typing or correction ribbon opposite the print point of a single element typewriter, and providing for automatic feeding of the ribbons, as desired, dependent upon the lift of the cartridge assembly.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed:

What is claimed is:

1. In a typewriter having provisions for receiving a typewriter print ribbon cartridge and a correction ribbon cartridge in superimposed relation to form a cartridge assembly, each of said cartridges including separate ribbon advancing means therein for moving respectively typewriter print ribbon and typewriter correction ribbon therethrough externally of said cartridges; cartridge assembly support means underlying said cartridge assembly and providing support therefor, and drive means for reciprocating said support means for presenting selectively different portions of said ribbons to a print point along a print line, only the respective ribbon being advanced which is presented to said print point, the improvement comprising:

first and second, spaced apart ratchets, each having ratchet teeth thereon and connected respectively to respective ones of said ribbon advancing means;

depending bracket means supporting said ratchets from said support means, said second ratchet connected to said correction ribbon advancing means and having ratchet teeth with a greater pitch than the teeth of the first ratchet;

first and second spaced apart drive pawl means pivotally mounted on said typewriter for engaging respectively said first and second ratchets during reciprocation thereof; and link means interconnecting said drive pawl means so that upon reciprocation of said support means a distance equal to or greater than the pitch of said teeth of said first ratchet but less than the pitch of the teeth of said second ratchet, only said first ratchet moves due to the engagement of said first drive pawl means with said first ratchet;

said second drive pawl means positioned so that upon reciprocation of said support means exceeding the pitch of the teeth of said second ratchet, said second drive pawl means effects movement of said second ratchet, said second ratchet operative for displacing said second drive pawl means about its pivot to displace said first drive pawl means because of said link means, away from said teeth of said first ratchet.

2. In a typewriter in accordance with claim 1 wherein said drive pawl means project upwardly adjacent said first and second ratchets, and means to urge said drive pawl means towards said teeth of said ratchets.

3. In a typewriter in accordance with claim 1 or 2 including pivot means connected to said cartridge assembly support means for reciprocation thereof about said pivot means.

4. In a typewriter in accordance with claim 3 wherein said first ratchet is closer to said pivot means than said second ratchet.

5. In a typewriter in accordance with claim 4 wherein said second drive pawl means is positioned at a greater angle with respect to a horizontal reference than said first drive pawl means.

6. In a typewriter in accordance with claim 4 wherein said second drive pawl means has a greater length than said first drive pawl means.

7. In a typewriter in accordance with claim 6 including stop means to limit the rotational motion of said drive pawl means.

8. In a typewriter in accordance with claim 7 including backcheck pawl means to inhibit reverse rotation of said ratchets.

9. In a typewriter in accordance with claim 7 wherein said second ratchet has a larger diameter, tooth-tip to-tooth-tip than said first ratchet.

10. In a typewriter in accordance with claim 3 wherein said second drive pawl means has a greater length than said first drive pawl means.

11. In a typewriter in accordance with claim 2 including stop means to limit the rotational motion of said drive pawl means.

12. In a typewriter in accordance with claim 11 including backcheck pawl means to inhibit reverse rotation of said ratchets.

13. In a typewriter in accordance with claim 11 wherein said second ratchet has a large diameter, tooth-tip to-tooth-tip than said first ratchet.

14. In a typewriter having provisions for receiving a typewriter print ribbon cartridge and a correction ribbon cartridge in superimposed relation to form a cartridge assembly, each of said cartridges including separate ribbon advancing means therein for moving respectively typewriter print ribbon and typewriter correction ribbon therethrough externally of said cartridges; cartridge assembly support means underlying said cartridge assembly and providing support therefor, and drive means for reciprocating said support means for presenting selectively different portions of said ribbons to a print point along a print line, only the respective ribbon being advanced which is presented to said print point, and a carrier mounting said cartridge assembly support means for translation thereof along said print line; the improvement comprising:

first and second, spaced apart ratchets, each having ratchet teeth thereon and connected respectively to respective ones of said ribbon advancing means;

depending bracket means supporting said ratchets from said support means, said second ratchet connected to said correction ribbon advancing means and having ratchet teeth with a greater pitch than the teeth of the first ratchet and an outside diameter greater than the outside diameter of said first ratchet;

first and second drive pawl means pivotally fixed to said carrier for engaging one of said first and second ratchets during reciprocation thereof by said support means; and means connecting said first drive pawl means to said second drive pawl means;

said first drive pawl means engaging said first ratchet when said support means reciprocates a distance equal to or greater than the pitch of said teeth of said first ratchet but less than the pitch of the teeth of said second ratchet, and when reciprocation of said support means exceeds the pitch of the teeth of said second ratchet, said second drive pawl means effects movement of said second ratchet, said second ratchet operative for displacing said second drive pawl means about its pivot and thus said first drive pawl means about its pivot away from engagement with said first ratchet, thereby inhibiting engagement of said first drive pawl means with said first ratchet.

15. In a typewriter in accordance with claim 14 including pivot means connected to said cartridge assembly support means for reciprocation thereof about said pivot means.

16. In a typewriter in accordance with claim 14 including stop means to limit the rotational motion of both of said drive pawl means.

17. In a typewriter in accordance with claim 16 including backcheck pawl means to inhibit reverse rotation of said ratchets.

18. In a typewriter in accordance with claim 15 wherein said first and second ratchets are displaced from each other so that said second ratchet is further from said pivot means than said first ratchet.

19. In a typewriter in accordance with claim 18 wherein said means connecting said first drive pawl means to said second drive pawl means comprises a link means interconnecting said drive pawl means.

20. In a typewriter in accordance with claim 19 wherein said first and second drive pawl means project upwardly adjacent said first and second ratchets, and means to urge said drive pawl means towards said teeth of said ratchets.

21. In a typewriter in accordance with claim 19 or 20 wherein said second drive pawl means is positioned at a greater angle with respect to a horizontal reference than said first drive pawl means.

* * * * *